United States Patent [19]

Watanabe

[11] Patent Number: 4,457,671

[45] Date of Patent: Jul. 3, 1984

[54] HERMETIC TYPE ROTARY COMPRESSOR WITH SILENCER MEANS

[75] Inventor: Yoshikuni Watanabe, Fujinomiya, Japan

[73] Assignee: Tokyo Shibaura Denki Kabushiki Kaisha, Kawasaki, Japan

[21] Appl. No.: 374,029

[22] Filed: May 3, 1982

[30] Foreign Application Priority Data

May 11, 1981 [JP] Japan ..... 56-67678

[51] Int. Cl.[3] ..... F04B 21/00; F04C 18/00

[52] U.S. Cl. ..... 417/312; 418/181; 403/408; 411/501; 417/902

[58] Field of Search ..... 418/181; 417/312, 313, 417/902; 62/296; 411/43, 70, 500, 501; 403/408, 405

[56] References Cited

U.S. PATENT DOCUMENTS

| | | | |
|---|---|---|---|
| 429,578 | 6/1890 | Niedringhaus | 411/501 |
| 2,507,336 | 5/1950 | Golliez | 417/312 |
| 3,031,861 | 5/1962 | McCormack | 62/296 |
| 3,270,955 | 9/1966 | Huyser | 418/181 |
| 3,459,275 | 8/1969 | Prillwitz et al. | 418/181 |
| 3,542,493 | 11/1970 | Alderson | 417/312 |
| 4,355,963 | 10/1982 | Tanaka | 418/63 |

*Primary Examiner*—John J. Vrablik
*Assistant Examiner*—John J. McGlew, Jr.
*Attorney, Agent, or Firm*—Stevens, Davis, Miller & Mosher

[57] ABSTRACT

A horizontal hermetic type rotary compressor to be used in a refrigerator, air conditioner, or the like comprises an outer hermetic casing provided at both ends with suction and discharge pipes for a gaseous refrigerant, a compression device contained in the casing and a motor operatively connected to the compression device in the casing. The compression device has a cylinder body on both sides of which main and sub-bearings are attached and a silencer is provided for the cylinder body. The silencer comprises a plurality of silencer chambers formed in casting in the cylinder body at portions outside of the peripheries of the bearings and communicated with each other and a pair of cover plates secured to the cylinder body by tubular rivets so as to hermetically seal openings of the silencer chambers on both sides of the cylinder body.

8 Claims, 6 Drawing Figures

HERMETIC TYPE ROTARY COMPRESSOR WITH SILENCER MEANS

BACKGROUND OF THE INVENTION

This invention relates to a horizontally arranged hermetic type rotary compressor to be used, for example, in an air conditioner or refrigerator, and more particularly, to a device for repressing noise generated in the compressor.

In a conventional horizontal hermetic rotary compressor, a motor and a compression device are contained within a hermetic cylindrical casing provided with suction and discharge pipes connected to the opposite sides thereof. The compression device comprises a crank shaft eccentrically and integrally mounted with the shaft of the motor, a roller surrounding the crank shaft, and a pair of bearings cooperating with the end surfaces of the crank shaft and the roller for defining suction and compression chambers. Gas, typically refrigerant gas, compressed by the compression device is discharged to one side of the device (the side opposite the motor) through a plurality of arcuate silencer chambers formed in a casting in a cylinder body of the compression device and connected in communication with one another. The gaseous refrigerant discharged to one side of the compression device is pumped out to a condenser first through an opening axially extending through a cylinder body, a space in the casing on the opposite side of the compression device and then the discharge pipe connected to the hermetic casing. Usually, the bearings have an outer diameter substantially equal to the inner diameter of the casing so as to seal the arcuate silencer chambers and prevent the compressed gaseous refrigerant from leaking out therefrom.

Consequently, the diameter of the bearings is relatively large and it is necessary to accurately and finely finish the contacting surfaces of both the cylinder body and the bearings so that they are in tight and sealed relationships and to prevent a decrease in the silencer performance as well as the compressor performance.

SUMMARY OF THE INVENTION

An object of this invention is to provide a horizontal hermetic compressor used for an air conditioner, refrigerator, or other similar type of cooling apparatus in which main and sub-bearings in a compression device are compactly constructed and have less weight in comparison with a conventional compressor.

Another object of this invention is to provide a hermetic compressor in which tubular rivets are effectively used to act as passage ways for gaseous refrigerant and lubricating oil as well as securing means.

A further object of this invention is to provide an improved hermetic compressor capable of enhancing silencing efficiency, preventing leakage of gaseous refrigerant, and leading to much less finishing grinding work of the surfaces of the main and sub-bearings.

According to this invention, there is provided a horizontal hermetic type rotary compressor to be used in a refrigerator, air conditioner, or the like of the type comprising an outer hermetic casing provided at both its end portions with a suction pipe and a discharge pipe for a flow medium, a compression device contained in the casing and connected to the suction pipe, and an electric motor operatively connected to the compression device, the compression device comprising a cylinder body and main and sub-bearings located on the respective side portions of the cylinder body and the cylinder body being provided with a silencer device, wherein the silencer device comprises a plurality of silencer chambers which are a casting in the cylinder body at portions outside of the peripheral edges of the main and sub-bearings and communicated with each other, and a pair of cover plates located on both sides of the cylinder body so as to hermetically seal openings of the silencer chambers, and the cover plate is secured to the cylinder body by tubular rivets.

DESCRIPTION OF THE PREFERRED EMBODIMENTS

Figure 1:
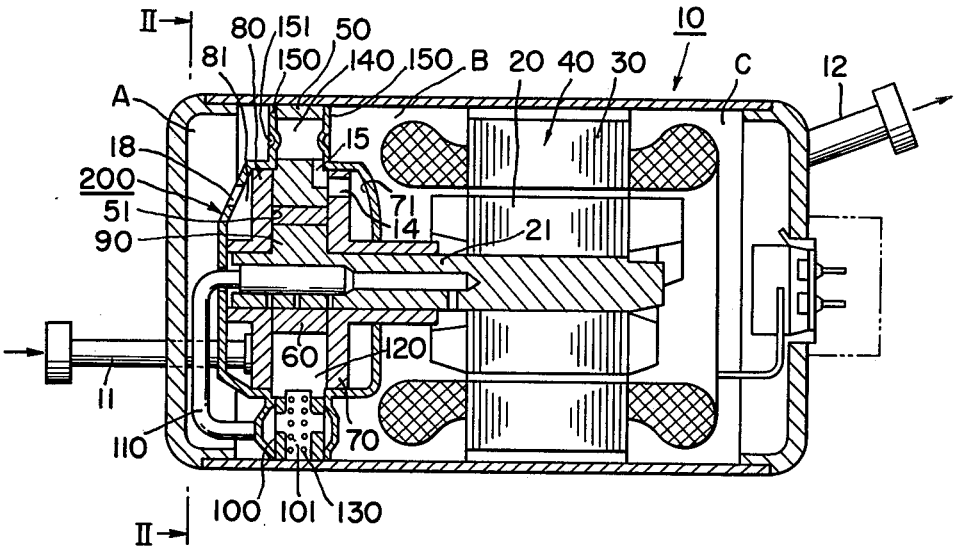
FIG. 1 is a longitudinal sectional view of a horizontal hermetic compressor according to this invention.
Figure 2:
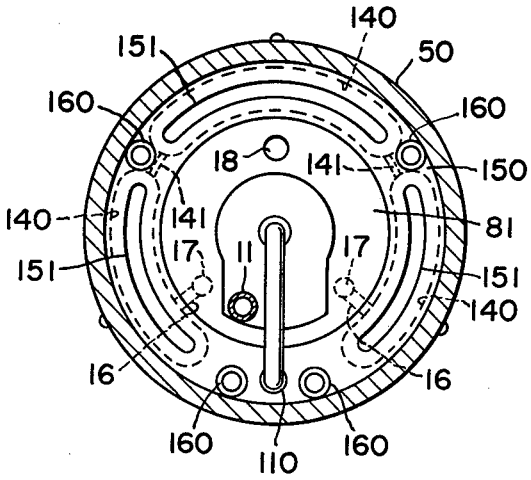
FIG. 2 is a cross sectional view taken along the line II—II in FIG. 1.
Figure 3:
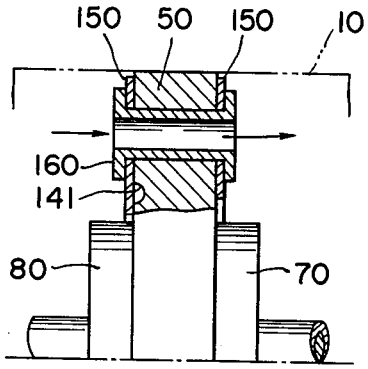
FIG. 3 is an enlarged cross sectional view of a tubular rivet having a refrigerant passage way located around the compression portion shown in FIG. 1.
Figure 4:
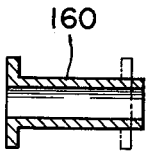
FIG. 4 is a cross sectional view of the tubular rivet used for the compressor shown in FIG. 1.

Referring now to FIGS. 1 through 4, a hermetic casing 10 is provided with a suction pipe 11 and a discharge pipe 12 at its respective horizontal ends for introducing and discharging a gaseous refrigerant.

The casing encapsules a motor 40 which comprises a stator 30 and a rotor 20 mounted inside the stator 30 in a spaced relationship. The rotor 20 has a cylindrical hollow core to which a motor shaft 21 is inserted and fixed tightly, hence, the motor shaft 21 rotates jointly with the revolving motion of the rotor 20.

At the other end of the motor shaft 21 is provided a compression portion 200 which comprises an eccentric crank shaft 90 integrally formed with the motor shaft 21, a cylinder body 50, a main bearing 70 having a cover plate 71, and a sub-bearing 80. The main and sub-bearings 70 and 80 are secured by bolt means, not shown, to both the outermost portions of the cylinder body 50.

The crank shaft 90 is surrounded by an annular-shaped roller 60 which is relatively loosely fitted along the circumference of the shaft 90 and sealed closely at both ends between the main bearing 70 and the sub-bearing 80. A hollow compression chamber is defined by the outer surface of the roller 60, the inner surface of the cylinder body 50, and the surfaces of the main and sub-bearings 70 and 80 adjacent to the cylinder body 50.

The compression chamber is divided into a high pressure room and a low pressure room by means of a blade 120 which extends vertically along the main and sub-bearings 70 and 80, and is compressed upwardly against the roller 60 by a cylindrical helical spring 130. On the blade 120 is exerted pressure by the spring 130 in such a manner that the blade 120 reciprocates in tune with the movement of the roller 60, always in contact with its surface.

Each of the bearings 70 and 80 is respectively covered by cover plates 150, 150. The cover plates extend around the compression device 200 and are fixed face to face across from each other, with the cylinder body 50 intervening them, by the set of rivets detailed later.

At the bottom of the compression device 200 is formed a lubricant reservoir, not shown, defined by both of the cover plates 150, 150, cylinder body 50 and the blade 120. A blade lubricating pump 100 provided with a blade chamber 101 operates in accordance with the reciprocal movement of the blade 120. A body of lubricant in the reservoir flows in, as the upward motion of the blade expands the confined volume and attracts lubricant in the vicinity, and pumps out, as the downward stroke of the blade diminishes the confined volume and expels lubricant. To the sub-bearing 80 is connected an oil supplying pipe 110 which communicates with the lubricant reservoir to transfer lubricant up into the cylindrical cave provided towards one end of the motor shaft 21 from which lubricant is further fed to a frictional contact portion. A plurality of silencer chambers 140 (FIG. 2) are formed in casting in the cylinder body 50 and these silencer chambers 140 extend along a cylinder bore 51 of the cylinder body 50 and are spaced equally apart from the inner side of the cylinder bore. They are in communication with each other by means of a plurality of tunnels 141. Since a pair of annular-shaped cover plates 150 are attached to the cylinder body 50 and hermetically seal both end openings of the silencer chambers 140, the peripheral brim of the main and sub-bearings 70 and 80 can be trimmed in size, thereby decreasing the mass and rendering the compression device compact. The cover plates 150 are secured to the cylinder body 50 by a plurality of tubular rivets 160 each of which has a hollow flow passage for the mixture of the refrigerant and the lubricating oil and the cover plates 150 are also provided with arcuate grooves 151 to increase stiffness of the cover plates 150.

Turning now to the refrigerant flow, the refrigerant and lubricating oil flow from a cabin A defined between the compression portion and one end of the hermetic casing 10 into a cabin B, being the space between the compression portion and the motor 40, through the tubular rivets 160, and finally into a cabin C defined by the motor and the other end of the hermetic casing 10.

The refrigerant compressed in the compression device 200 flows through a discharge valve, not shown, a discharge port 14 formed in the main bearing 70, and a discharge channel 15 formed in the cylinder body 50 and then flows into the silencer chambers 140. Thereafter, the refrigerant is guided into a chamber 81 formed in the sub-bearing 80 through discharge channels 16 and 17 also formed therein and then flows into the cabin A through a discharge port 18 formed in the cover plate 150. The refrigerant in the cabin A then passes into the cabin B through the tubular rivets 16, the cabin C through channels between the stator 30 and the rotor 20, and then towards the discharge pipe 12, thereby reducing the noise generated in the compression process.

According to this invention, since the silencer chambers 140 are formed in the cylinder body 50 at portions outside of the outer peripheries of the main and sub-bearings 70 and 80, each of bearings thus has a smaller diameter than that of the prior type described hereinbefore. In addition, the use of the tubular rivets 160 which act as flow passages for the mixture of the refrigerant and the lubricating oil helps save members or means as compared with the conventional devices and reduce the complication of the construction and assembly.

A valve cover for the sub-bearing 80 can be optional in this invention, as opposed to cover plate 71 for the main bearing 70 which is an essential element for routing the discharged refrigerant through the port, channels, and passages in a manner described above. Moreover, although the silencer chambers 140 can be cast in a arcuate shape in the preferred embodiment, they may have a configulation other than an arcuate shape.

Figure 5:
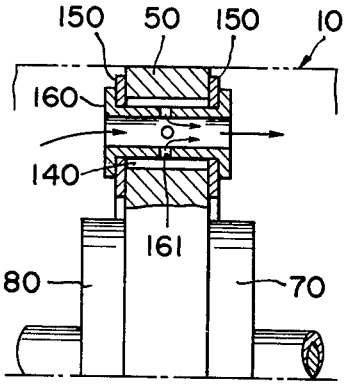
FIGS. 5 and 6 are cross sectional views of the rivet portions of the other embodiments of this invention.

FIG. 5 shows another embodiment of this invention, in which the tubular rivet 16 is located in and across the silencer chamber 140 and has small holes 161 around its tubular body which allows the refrigerant from the silencer chamber into the passage way to be blended with the lubricating oil.

Figure 6:
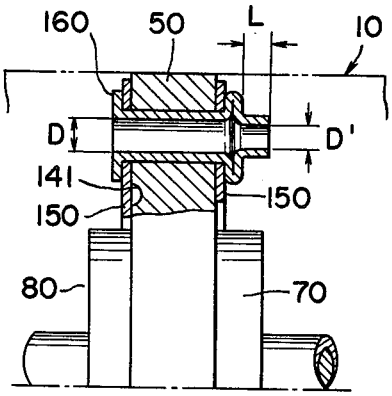

FIG. 6 shows a further embodiment of this invention, in which each tubular rivet 16 has an inlet opening having a larger diameter D than a diameter D′ of an outlet opening thereof provided with an extension having a dimension L, thereby to increase silencing efficiency.

In all embodiments described hereinabove, the cover plate 150 may be constructed to be integral with or separate from the valve cover.

According to this invention, as described hereinabove, since silencer chambers are cast in a cylinder body of a compression device at portions outside of the peripheral edge of a cylinder bore of the cylinder body, and in other words, the outer peripheries of main and sub-bearings do not extend over the inner peripheries of the arcuate silencer chambers, the bearings for the compression device can be made compact and of lighter weight. In addition, a pair of cover plates are attached to the bearings by tubular rivets at positions suitable for hermetically sealing the openings of the siliencer chambers, the tubular rivets also acting as passage ways for refrigerant and lubricating oil. Moreover, according to this invention, finish grinding work of assembled parts can be alleviated to a significant degree.

What is claimed is:

1. In a horizontal hermetic type rotary compressor of the type comprising an outer hermetic casing provided at both its end portions with a suction pipe and a discharge pipe for a flow medium, a compression device contained in said casing and connected to said suction pipe, and an electric motor operatively connected to said compression device, said compression device comprising a cylinder body, and main and sub-bearings located on the respective side portions of said cylinder body, said cylinder body being provided with silencer means, the improvement in which said silencer means comprises:

a plurality of silencer chambers which communicate with each other and which are formed in said cylinder body at portions outside of the peripheral edges of said main and sub-bearings; and, a pair of cover plates located on both sides of said cylinder body so as to hermetically seal openings of said silencer chambers, said cover plates being secured to said cylinder body by tubular rivets.

2. The compressor according to claim 1 wherein each of said silencer chambers has an arcuate configuration.

3. The compressor according to claim 1 wherein said tubular rivets are constructed to act as passages for said flow medium as well as securing means.

4. The compressor according to claim 1 wherein said main bearing is provided with a valve cover which is integrally formed with one of said cover plates.

5. The compressor according to claim 1 wherein each of said tubular rivets has an inlet opening having a larger diameter than that of an outlet opening of the same.

6. The compressor according to claim 1 wherein said tubular rivets are provided with circumferential holes and located at positions where said holes are communicated with said silencer chambers.

7. The compressor according to claim 1 wherein said cover plates are provided with arcuate grooves, respectively.

8. In a horizontal hermetic type rotary compressor of the type comprising an outer casing provided at both its end portions with a suction pipe and a discharge pipe for a flow medium, a compression device contained in said casing and connected to said suction pipe, and an electric motor operatively connected to said compression device, said compression device comprising a cylinder body, and main and sub-bearings located on the sides of said cylinder body, and said cylinder body is provided with silencer means, the improvement in which said silencer means comprises:

a plurality of silencer chambers which communicate with each other and which are formed in said cylinder body at portions outside of the peripheral edges of said main and sub-bearings; and, a pair of cover plates located on both sides of said cylinder body so as to hermetically seal openings of said silencer chambers, said cover plates being secured to said cylinder body by tubular rivets, said compression device being provided with a discharge valve operatively communicated with said suction pipe, and main bearing being provided with a first discharge port communicated with said discharge valve, said cylinder body being provided with a second discharge port communicated with said first discharge port, said second discharge port being communicated with said silencer chambers, with which a third discharge port formed in said cylinder body is communicated, said sub-bearing being provided with a fourth discharge port and also provided with a chamber, said fourth discharge port being communicated with a fifth discharge port formed to said chamber, said fifth discharge port being communicated with a first cabin formed in said casing, said first cabin being communicated with a second cabin formed in said casing through said tubular rivets, said second cabin being communicated with a third cabin formed in said casing through a space defined in said motor, said third cabin being communicated with said discharge pipe, whereby said flow medium sucked into said compression device flows towards said discharge pipe from said suction pipe through said discharge valve, said first through fifth discharge ports, said silencer chambers, and said first through third cabins.

* * * * *